United States Patent [19]

Bryceland

[11] 4,043,115

[45] Aug. 23, 1977

[54] PUSH BUTTON ASSEMBLY AND ELECTRONIC WATCH INCLUDING THE SAME

[75] Inventor: Maurice Cyril Bryceland, Dover, N.J.

[73] Assignee: Waldman Corporation, Parsippany, N.J.

[21] Appl. No.: 617,589

[22] Filed: Sept. 29, 1975

[51] Int. Cl.[2] ..... G04B 19/30; H01H 3/12

[52] U.S. Cl. ..... 58/50 R; 58/90 B; 200/159 R; 200/340

[58] Field of Search ..... 200/159 R, 159 A, 159 B, 200/340, 11 R, 52 R; 58/23 R, 50 R, 90 B

[56] References Cited

U.S. PATENT DOCUMENTS

| | | | |
|---|---|---|---|
| 3,367,206 | 2/1968 | Moody | 200/340 X |
| 3,783,607 | 1/1974 | Feurer | 58/90 B |
| 3,792,219 | 2/1974 | Rowley | 200/159 R |
| 3,924,400 | 12/1975 | Carlone | 58/50 R |
| 3,946,182 | 3/1976 | Holder | 200/159 B |
| 3,952,176 | 4/1976 | Holder et al. | 200/11 R |

*Primary Examiner*—James R. Scott
*Attorney, Agent, or Firm*—Shapiro and Shapiro

[57] ABSTRACT

A push button assembly for an electronic watch or the like includes a metallic body with an axial bore in which a metallic stem is forwardly slideable from a rear terminal position against the action of a spring member. By mounting an insulating tubular locator sleeve of known length on the forward end of the body, the forward end of the stem is axially spaced rearwardly of the forward free end of the locator sleeve a predetermined distance. With such push button assembly, the stem may electrically engage a contact independent of the accumulation of tolerances associated with the manufacture of the cases and the modules which the push button assemblies are assembled.

14 Claims, 5 Drawing Figures

PUSH BUTTON ASSEMBLY AND ELECTRONIC WATCH INCLUDING THE SAME

This invention relates to a push button assembly for an electronic watch or the like, and to an electronic watch or the like into which such an assembly is incorporated.

BACKGROUND OF THE INVENTION

An electronic watch employs a crystal-controlled oscillator for developing a high frequency time standard, solid state logic circuits driven by the oscillator for producing timing signals, and a low power consumption solid state display responsive to the timing signals for producing time-denoting digital indicia. These components are incorporated in modules that have exposed contacts by which modular interconnections are achieved when assembled into a watch case.

In order to activate the display and render the indicia visible, and in order to set the digits of the display when the power supply is changed, the case may be provided with one or more manually operable switches. Many electronic watches utilize a push button type of switch similar to that shown in U.S. Pat. No. 3,783,607, When the exposed head of such a push button is manually depressed sufficiently far, a metal stem connected to the head and spring biased to a rear terminal position, moves forwardly into mechanical and hence electrical engagement with an exposed contact (termed a switching contact) carried by a module associated with the push button. Such engagement effects the desired switching operation by completing an electrical connection between the contact and the watch case which provides a convenient reference potential (ground) for the circuitry of the watch.

Assembly an electronic watch involves inserting the necessary modules into a case on which the required push button assemblies have been mounted. Upon final assembly, the contact of the module associated with a push button assembly should be located a predetermined distance from the forward end of the stem of the push button assembly when the stem is in its rear terminal position in order for each push button assembly to have a uniform stroke. Uniformity has not been achieved, however, in the volume production of electronic watches because of the manufacturing tolerances on electronic modules, cases and push button assemblies which are mass produced by different manufacturers. By reason of the accumulation of tolerances on particular components chosen for assembly, the stroke of a push button assembly necessary to electrically connect a contact on a module to the case may vary widely from one push button assembly to another. Furthermore, under worst-case conditions of accumulated tolerances, the available stroke of a given push button assembly may be too short to enable its stem to electrically engage its associated contact.

Much effort has been devoted to this problem, but so far as is known, no realistic solution has heretofore been found other than reducing manufacturing tolerances, a solution that drives up manufacturing costs without achieving any compensatory improvement in product performance. It is therefore an object of the present invention to provide a new and improved push button assembly for an electronic watch wherein the length of the stroke of the stem of the push button assembly necessary to achieve an electrical connection with its associated contact is fixed and independent of manufacturing tolerances on the case and on the modules.

BRIEF DESCRIPTION OF THE INVENTION

Briefly, the push button assembly of the present invention comprises a metallic body with an axial bore in which a metallic stem is forwardly slideable from a rear terminal position against the action of a spring member, and an insulating tubular locator sleeve is mounted in the forward end of the body so that the forward end of the stem can move coaxially in the sleeve. When the stem is in its rear terminal position, its forward end is axially spaced rearwardly of the forward free end of the locator sleeve by a predetermined distance whose tolerance from one push button assembly to another can be closely controlled. Such distance is the length of the stem stroke necessary to electrically connect the case to the contact of the module associated with the push button assembly, provided only that the latter is assembled into a watch. Thus, the stroke of the push button assembly is fixed and independent of any tolerances involved in manufacturing the case and the module.

In order to insure that the free end of the locator sleeve of a push button assembly will always engage the contact of the module associated with the push button assembly, the contact is in the form of a cantilevered conductor whose unstressed position is such as to interfere with the locator sleeve under the "worst-case" accumulations of tolerances of the modules and the cases. This insures that, after final assembly, the cantilevered conductor will be in resilient engagement with the free end of the locator sleeve, and thus the contact always will be located at a predetermined distance from the forward end of the stem when the latter is in its rear terminal position

BRIEF DESCRIPTION OF THE DRAWINGS

Embodiments of the invention are illustrated in the accompanying drawings wherein.

DESCRIPTION OF THE PREFERRED EMBODIMENTS

Figure 1:
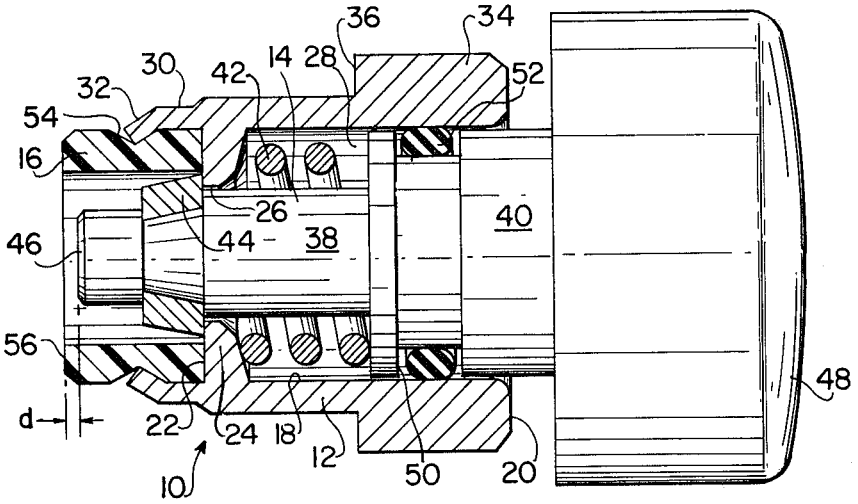
FIG. 1 is a side elevational view, partly in section, of one embodiment of a push button assembly made in accordance with the invention.
Figure 2:
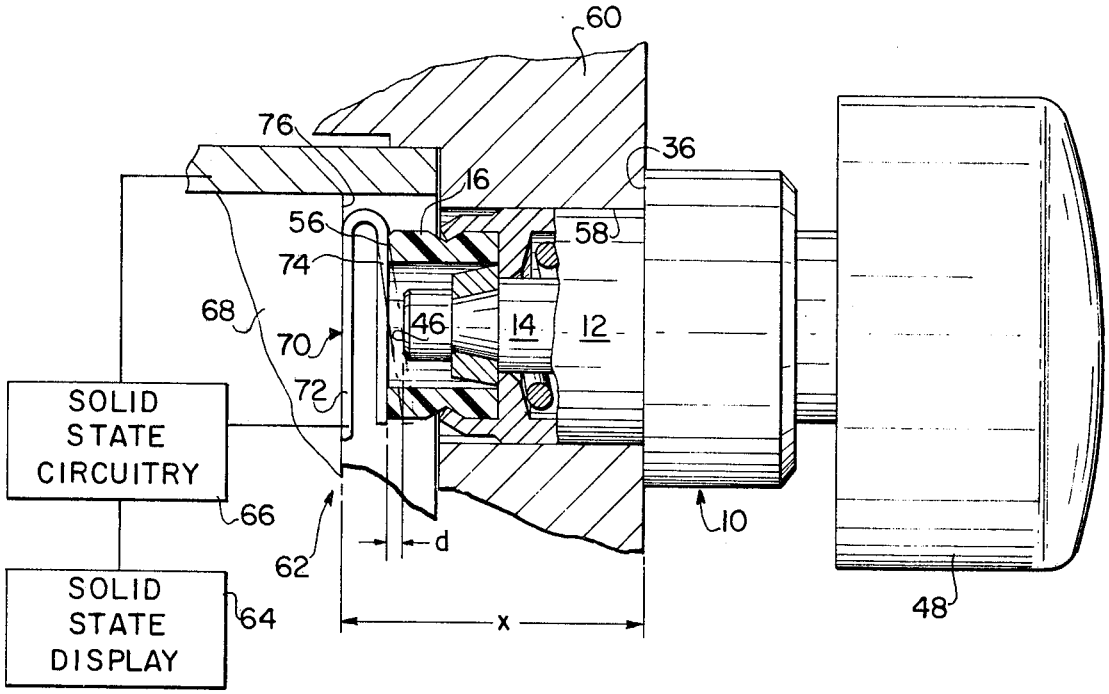
FIG. 2 is a combined schematic and side elevational view of an electronic watch according to the invention showing the push button assembly of FIG. 1 in its unactuated state mounted in a watch case.

Referring to FIG. 1, the push button assembly generally designated 10 comprises a body 12, a stem 14 and a locator sleeve 16. The body is metallic, preferably stainless steel, and has an axial bore 18 extending therethrough comprising rearward portion 28 opening at the rearward end 20 of the body and forward portion 26 opening at the forward end 22 of the body. Bore portion 26 is constituted by a round aperture in web 24 located adjacent end 22 having a diameter less than the diameter of portion 28. Projecting forwardly of web 24, the body has a cylindrical tubular mounting wall 30 terminating in free end 32 that is crimped or swaged inwardly as shown in FIG. 1 to grip the sleeve 16. Finally, the body 12 is provided with a flanged head 34 at its rearward end defining a locator shoulder 36 that establishes the axial position of the push button assembly in a watch case as shown in FIG. 2.

Still referring to FIG. 1, stem 14 has central cylindrical portion 38 slideably received in aperture 26 of web 24, and a hub 40 rearward of portion 38 of a diameter that enables the hub to be slideably received in portion 28 of the bore. Thus, stem 14 is constrained to move axially forwardly and rearwardly in the bore. A coiled compression spring 42, which is preferably of stainless steel, is interposed between web 24 and hub 40 and resiliently urges the stem in the rearward direction to its rear terminal position shown in FIG. 1. Such position is established by the engagement of the forward face of web 24 with a collar 44 fixed to the stem forwardly of portion 38.

At least the forward end 46 of the stem must be electrically connected to the body 12, and preferably, this is achieved by the sliding engagement between the stem and the body and the engagement of the spring with both the body and the stem. The rearward end of the stem is provided with an enlarged head 48 projecting rearwardly beyond the flanged head 34 of the body. Head 48 is thus accessible for effecting manual displacement of the stem against the action of spring 42. Finally, hub 40 is provided with a circumferential groove 50 for receiving O-ring 52 which resiliently bears against portion 28 of the bore and environmentally seals the rear end of the bore.

Locator sleeve 16 is a tubular member of rigid insulating material, preferably a molded phenolic resin, having an outer diameter that fits within tubular mounting wall 30 of body 12. In the embodiment of FIG. 1, sleeve 16 has a substantially uniform wall thickness and is provided with a circumferential groove 54 that receives the inturned free end 32 of wall 30 for retaining the sleeve to the body. In this position on the body, the axes of the sleeve 16 and of the bore 18 are aligned or colinear. Sleeve 16 also has free end 56 that is axially spaced forwardly of the free end 46 of stem 14 by a fixed distance $d$ when the stem is in its rear terminal position (i.e., when collar 44 engages web 24). Thus, manual forwardly directed pressure on head 48 that moves the same through a displacement $d$ will displace the stem in a forward direction from its rear terminal position until the free end 46 of the stem is in the plane of the free end 56 of the locator sleeve.

In assembling the components of the push button assembly 10, O-ring 52 is first slipped into groove 50 in hub 40 of stem 14. Spring 42 is then passed onto forward end 46 until the spring surrounds portion 38 and abuts hub 40. Forward end 46 of the stem is then inserted into portion 28 of bore 18 of the body until portion 38 is slideable in aperture 26, and the forward end projects beyond web 24 allowing collar 44 to be swaged onto the stem just to the rear of forward end 46 thus retaining the components together. Locator sleeve 16 is then inserted into tubular mounting wall 30 of the body into abutment with web 24. Thereafter, free end 32 of the mounting wall is crimped inwardly into groove 54 of the sleeve completing the assembly.

Referring now to FIG. 2, push button assembly 10 is shown pressed into aperture 58 of a metallic watch case 60 of electronic watch 62 so that locator shoulder 36 of body 12 engages the outer surface of the case. Case 60 may be of stainless steel or any metal plated with a precious metal, and press-fitting of the push button assembly into aperture 58 assures good electrical contact therebetween. Contained within the case of the watch is the watch module, consisting of a solid state display 64, logic circuits 66, oscillator, battery and switch contacts which are associated with the push button assembly. The module carries a contact 70 electrically connected to circuitry 66 but is otherwise electrically isolated from case 60, and is designed, for example, to carry out a switching function such as activating the display to render it visible when the contact is electrically connected to the case through stem 14.

Still referring to FIG. 2, a contact 70 is aligned with aperture 58, and preferably is in the form of a cantilevered spring having a built-in leg 72 rigidly attached to switching module 68 and a spring leg 74 that resiliently abuts free end 56 of locator sleeve 16 of the push button assembly. Thus, after all of the components of the watch are assembled into case 60, free end 46 of stem 14 of the push button assembly is spaced a distance $d$ from spring leg 74. This is the situation regardless of the variations from one watch to another in the distance $x$ between the outer surface 76 of the module and the outer surface of the case, which variations arise from manufacturing tolerances on the case and on the modules. Consequently, manual pressure on head 48 in the forward direction indicated by the arrow in FIG. 3 causes contact 70 to be electrically connected to the case as stem 14 is displaced forwardly from its rear terminal position as shown in FIG. 2 through the fixed or known distance $d$ to the position shown in FIG. 3. Such distance is established by the manufacturer of the push button assembly and the tolerance on this distance can be as small as desired without interfering with the tolerances on the case and modules.

In order to insure that contact 70 will engage the free end 56 of the locator sleeve upon assembly of the push button assembly into the case, leg 74 should have an unstressed position (see phantom lines in FIG. 2) at which it will interfere with the locator sleeve as the body of the push button assembly is pressed into the case. As locator shoulder 36 on the body is pressed into abutting contact with the outer surface of the case, leg 74 will press resiliently against free end 56. by using a cantilever type of spring contact, this requirement is easily satisfied without introducing any restrictions on the manufacturing tolerances of the cases and modules.

Figure 4:
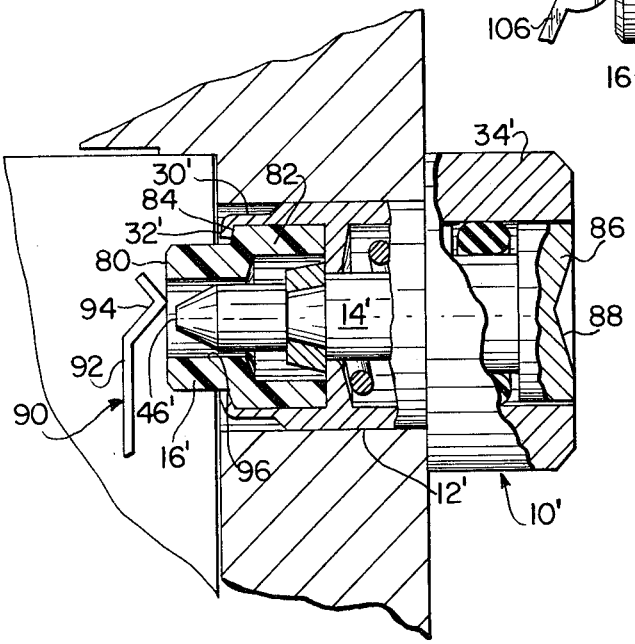
FIG. 4 is a view similar to FIG. 2 showing another embodiment of the push button assembly.

Referring to FIG. 4, the push button assembly of this embodiment is designated 10'. Two features distinguish this embodiment from the push button assembly previously described: the shape and the means of retention for the locator sleeve, and the character of the head on the stem. Locator sleeve 16' of push button assembly 10' has a forward free end 80 of a diameter smaller than the diameter of the rearward end 82 so as to define an intermediate annular shoulder 84. After insertion of end 82 within tubular mounting wall 30' of body 12', free end 32' of the wall can be swaged inwardly to overlie shoulder 84 and there retain the sleeve to the body.

Head 86 of push button assembly 10' is recessed within flanged head 34' of body 12' and the portion exposed to manual manipulation is provided with a tactile surface in the form of a central conical depression 88. When the stem 14' of this embodiment is in its rear terminal position as shown in FIG. 4, surface 88 is accessible and permits this push button assembly to be distinguished from push button assembly 10 by tactile as well as visual identification. By arranging for the push button assemblies of a given watch to be distinguished by tactile means as well as by visual means, electrical actuation of the desired push button assembly under conditions of total darkness can be carried out without error.

Figure 3:
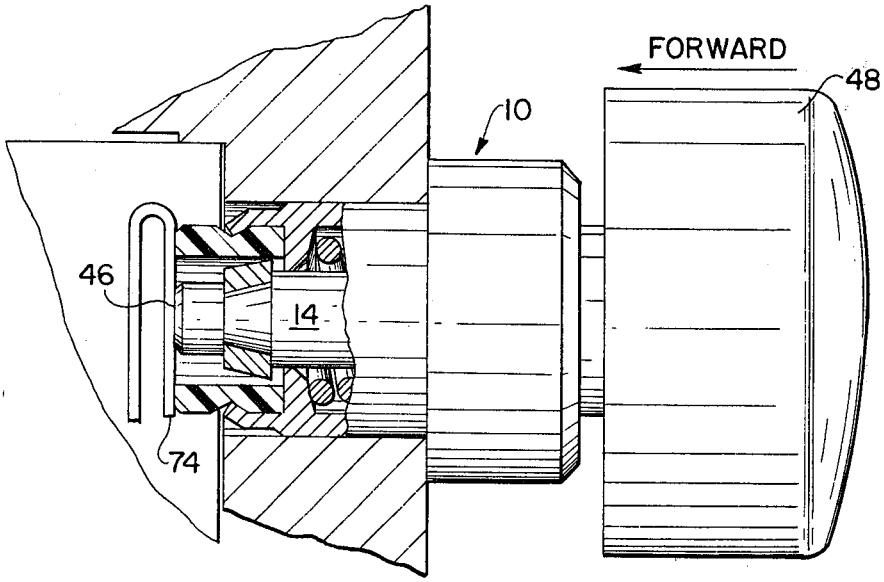
FIG. 3 is a partial view of the watch of FIG. 2 but showing the push button assembly in its actuated state.

FIG. 4 also illustrates another type of contact that can be used instead of the U-shaped contact 70 shown in FIGS. 1–3. Contact 90 is yieldably mounted on a module (not shown) but comprises a single spring leg 92, one end of which is rigidly attached to the module. The other end of leg 92 is free and is shaped in the form of a hook 94. The width of hook 94 (i.e., the dimension thereof perpendicular to the view shown in FIG. 4) is sufficiently large to project across the opening 96 in sleeve 16' to insure that forward end 46' of stem 14' will engage with hook 94 after the predetermined displacement of the stem from its rear terminal position. Leg 92 has an unstressed position that interferes with free end 80 of sleeve 16' insuring that hook 94 will resiliently press against the free end when the stem is in its rear position.

It is believed apparent that contacts 70 and 90 are merely illustrative of the many different types of yielding contacts than can be used to carry out the present invention. Furthermore, it should be understood that sleeves 16 and 16' are merely illustrative of insulating sleeves suitable for practicing the invention, and that the shape and material can be varied from what is shown in the drawings without departing from the spirit of the invention. Fianlly, the styles of head shown in two embodiments of the push button assembly of the present invention are merely illustrative of the many styles and configurations of heads that can be used.

Figure 5:
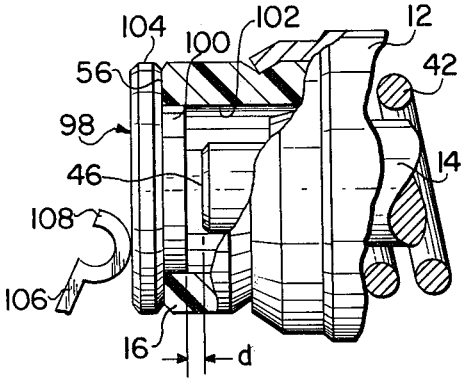
FIG. 5 is a partial side elevational view showing a modification of the forward end of the push button assembly, portions being broken away and in section.

The modification shown in FIG. 5 is applicable to either push button assembly 10 or push button assembly 10 or push button assembly 10' and involves the application to the free end of the insulating locator sleeve of a metal plug that serves to provide a positive environmental seal of the interior of the watch case and to provide a common electrical interface between the contact and the stem. As shown in FIG. 5, plug 98 has a rear disc portion 100 that snugly fits into the opening 102 of locator sleeve 16, and a front flange 104 that abuts free end 56 of the sleeve. Plug 98 is thus insulated from both stem 14 and body 12 by insulating sleeve 16. Yieldable contact 106 mounted on a module (not shown) associated with the push button assembly has a rounded free end 108 that resiliently engages plug 98 when the push button assembly is assembled into a case (not shown) and insures electrical continuity with the plug. The rear face of disc portion 100 is spaced from free end 46 of stem 14 a predetermined distance *d* as in the case of the other push button assemblies. Forward movement of the stem from its rear terminal position against the action of spring 42 through the predetermined distance *d* will result in free end 46 abutting portion 100 thus providing a good electrical connection between contact 106 and the case.

The use of a conductive plug on the free end of the locator sleeve is merely optional. It should be understood, therefore, that the term "free end means" as applied to the locator sleeves disclosed herein refers to the free end 56 of locator sleeve 16 or to the free end 80 of sleeve 16', when neither sleeve utilizes a conductive plug, and to plug 98 on sleeve 16. In all cases, the free end means of the locator member is insulated from both the stem and the body of the push button assembly until the stem is moved through a predetermined displacement.

It is believed that the advantages and improved results afforded by the push button assembly and the electronic watch including the same as hereinbefore described will be apparent from the foregoing description of the preferred embodiments of the invention. Various changes and modifications may be made without departing from the spirit and scope of the invention as sought to be defined in the following claims.

I claim:

1. A push button assembly for an electronic watch or the like comprising:

a. a metallic body having an axial bore;

b. a stem slideable in the bore, and having a forward end that is in electrical circuit with the body, the length of the stem being not less than the length of the body;

c. a spring member urging the stem rearwardly to a rear terminal position;

d. a hollow locator member having free end means integral therewith, said locator member being connected to the body and electrically insulated from both the stem and the body; and e. the forward end of the stem being positioned within the locator member and axially spaced rearwardly of the free end means of the locator member by a fixed distance when the stem is in its rear terminal position.

2. A push button assembly according to claim 1 wherein said locator member comprises a sleeve of insulating material having its axis colinear with the axis of the bore so that the forward end of the stem is positoned coaxially within the sleeve, and a conductive plug on the free end of the sleeve for wealing the same and defining the free end means of the locator member.

3. A push button assembly according to claim 1 including a head on the rearward end of the stem for manually displacing the same forwardly through said fixed distance against the action of the spring member.

4. A push button assembly according to claim 1 wherein said locator member is of insulating material.

5. A pushbutton assembly according to claim 4 wherein said locator member is a hollow sleeve whose axis is colinear with the axis of the bore.

6. A push button assembly according to claim 5 wherein said head is enlarged with respect to the bore and projects outwardly therefrom.

7. A push button assembly according to claim 5 wherein said head is recessed in the bore and has tactile means accessible at the rear terminus of the bore.

8. A push button assembly according to claim 1 including:

a. a web in the bore intermediate its ends having a central aperture;

b. the portion of the bore rearward of the web being cylindrical in shape with a diameter greater than the diameter of the aperture in the web;

c. the stem having a central cylindrical portion slideably received in the aperture in the web, and a hub having a circumferentially groove rearwards of the central portion slideably received in the rearward portion of the bore;

d. an O-ring mounted in the groove; and e. the spring member is a coiled compression spring interposed between said web and said hub.

9. A push button assembly according to claim 8 including a stop on the stem adjacent the forward end thereof and forward of the web, the stop being engageable with the web under the action of the coiled spring to define the rear terminal position of the stem.

10. A push button assembly according to claim 8 wherein the body has a cylindrical mounting wall projecting forwardly of the web and terminating in a free end, and said locator member is a hollow sleeve of insulating material disposed within the mounting wall and projecting beyond the free end thereof.

11. A pushbutton assembly according to claim 10 wherein the sleeve has a uniform wall thickness and a circumferential groove in its outer surface for receiving the free end of the mounting wall to retain the sleeve to the body.

12. A push button assembly according to claim 10 wherein the sleeve has a forward free end of a diameter smaller than the diameter of the rearward end defining an intermediate annular shoulder, and the free end of said mounting wall overlies said shoulder to retain the sleeve to the body.

13. A push button assembly including a metallic body with an axial bore, a metallic stem slideable in the bore, and a spring member urging the stem rearwardly to a rear terminal position, the improvement comprising a hollow insulating locator sleeve mounted on the forward end of the body in coaxial relationship to the stem and having a forward free end axially spaced forwardly of the forward end of the stem a fixed distance when the latter is in its rear terminal position, the forward end of the stem being positioned within the locator sleeve in said rear terminal position.

14. A digital watch comprising:

a. a metallic case having a display and an apertured wall;

b. a push button assembly including:

1. a metallic body mounted in the aperture in electrical contact with the case and having an axial bore colinear with the aperture;
2. a metallic stem slideable in the bore, the length of the stem being not less than the length of the body;
3. a spring member urging the stem rearwardly to a rear terminal position;
4. a head on the rearward end of the stem for selectively forwardly displacing the stem against the action of the spring member; and
5. an insulating locator sleeve mounted on the forward end of the body in coaxial relationship with the stem, the sleeve having a forward free end axially spaced forwardly of the forward end of the stem a fixed distance when the latter is in its rear terminal position, the forward end of the stem being positioned within the locator sleeve in said rear terminal position; and c. a module within the case containing electronic circuitry for driving said display and having a yieldable conductor in resilient engagement with the forward free end of the locator sleeve of the push button assembly.

* * * * *